US005828930A

United States Patent [19]

Matsumoto et al.

[11] Patent Number: 5,828,930

[45] Date of Patent: Oct. 27, 1998

[54] ELECTROSTATIC RECORDING APPARATUS AND ITS RECORDING METHOD

[75] Inventors: Shogo Matsumoto; Yasushi Kinoshita, both of Ibaraki-ken; Junichi Matsuno, Tsuchiura, all of Japan

[73] Assignee: Hitachi, Ltd., Tokyo, Japan

[21] Appl. No.: 828,171

[22] Filed: Mar. 18, 1997

[30] Foreign Application Priority Data

Mar. 19, 1996 [JP] Japan ..... 8-062485

[51] Int. Cl.[6] ..... G03G 21/20; G03G 13/05

[52] U.S. Cl. ..... 399/135; 399/44

[58] Field of Search ..... 399/135, 44, 130, 399/168

[56] References Cited

U.S. PATENT DOCUMENTS

| | | | |
|---|---|---|---|
| 3,634,007 | 1/1972 | Verderber et al. | 399/44 |
| 3,677,632 | 7/1972 | MacDonald | 399/44 |
| 4,318,002 | 3/1982 | Pressman et al. | 399/135 |
| 4,340,296 | 7/1982 | Ohara et al. | 399/135 |
| 5,539,498 | 7/1996 | De Cock et al. | 399/44 |
| 5,600,427 | 2/1997 | Watanabe et al. | 399/44 X |

*Primary Examiner*—R. L. Moses

*Attorney, Agent, or Firm*—Antonelli, Terry, Stout & Kraus, LLP

[57] ABSTRACT

An electrostatic recording apparatus using an ion flow is constructed by: a recording paper inserting slot into which a recording paper as a recording medium is inserted; a humidistat for reducing a moisture content of the recording paper; a latent image forming unit for forming an electrostatic latent image onto the recording paper; a charge amount detecting unit for measuring a charge amount of the recording paper; developing units corresponding to respective colors; and a recording paper ejecting slot for ejecting the recording paper. Thus, an electrostatic latent image can be directly stably formed on a general paper.

9 Claims, 10 Drawing Sheets

SURFACE RESISTANCE VALUE CHARACTERISTICS

HUMIDITY CHARACTERISTICS OF ELECTROSTATIC RECORDING PAPER

ELECTROSTATIC RECORDING APPARATUS AND ITS RECORDING METHOD

BACKGROUND OF THE INVENTION

The invention relates to an electrostatic recording apparatus for forming an electrostatic latent image onto a recording medium, developing the electrostatic latent image, and forming an image.

As a technique for irradiating ions onto a recording medium and forming an electrostatic latent image, a technique disclosed in JP-A-63-147660 has been known. According to such a technique, ions are generated by an ion generating source having a corotron shield casing and a corona wire. As for the ions, electric potential differences among the corona wire, ion flow control plate (control electrode), and a conductive layer of a back surface of the recording medium are set to a proper relation, thereby leading an ion flow onto the recording medium. In this instance, by changing an amount of ions passing through an opening portion of the ion flow control plate, an arbitrary electrostatic latent image is formed. By developing the electrostatic latent image by toner, a desired image is derived. According to the technique as mentioned above, a special recording medium (electrostatic recording apparatus) having a laminated structure of a dielectric layer and a conductive layer is used.

In Shimizu, "Ion flow printer" ("Proceedings of Printing and Information Recording Session", pages 7–12, 1993), a technique for recording by using a general recording paper (general paper) which doesn't have the laminated structure as mentioned above is disclosed. According to such a technique, a dielectric drum having a recording holding member made of a dielectric material is provided as a first recording medium. After an electrostatic latent image was formed on the recording holding member, it is developed and a toner image is formed.

In the above prior art, a special electrostatic recording paper or dielectric drum is used as a recording medium on which an electrostatic latent image is formed by irradiating ions. The recording medium to which ions are irradiated and on which an electrostatic latent image is formed needs to hold the ions (charges) at a desired position. The electrostatic recording paper has characteristics such that the ions can be held at a desired position. To explain those characteristics, FIG. 13 shows changes in surface resistances of an electrostatic recording paper and a general paper for a change in ambient humidity. In case of the electrostatic recording paper, even when humidity changes within a range from 20 to 80%, an electric surface resistance value of about $10^7$ ω is maintained and doesn't change by up to ten times. On the other hand, in case of the general paper, it changes up to about $10^8$ to $10^6$ ω. Although all of the electrostatic recording papers and general papers don't always cause such a change in surface resistance value, a tendency of such a change becomes a standard to distinguish the electrostatic recording paper and the general paper.

To hold the ions onto the surface of the recording medium on which the electrostatic latent image is formed, it is necessary that the recording surface has a certain degree of surface resistance value. To always obtain a constant image quality, it is necessary that the surface resistance value doesn't largely change even if the ambient humidity changes, namely, an extent of humidity of the recording medium changes. A dielectric material which is used as an electrostatic recording paper is selected so as to satisfy the above conditions. The same shall also similarly apply to the recording holding member of a dielectric roller. On the other hand, in case of the general paper, since the surface resistance value largely changes in an ordinary use environment (ambient humidity lies within a range from 20 to 80%) as mentioned above, the general paper cannot endure the use as a recording medium.

From the above reasons, in the electrostatic recording apparatus of the ion flow recording system, it is necessary to use the exclusive-use electrostatic recording paper. Or, in order to allow the user to freely select a recording paper that is used, it is necessary to use a recording method whereby an electrostatic latent image is formed onto an exclusive-use recording holding member such as a dielectric roller or the like and an image formed by developing the latent image by toner is transferred onto the general paper. However, in case of transferring the image from the exclusive-use recording holding member such as a dielectric roller or the like onto the general paper, a device for matching the positions of the dielectric roller, recording holding member, and general paper as a recording medium is necessary and the apparatus is complicated or enlarged, so that it is unpreferable. Since a recording step of transferring from the exclusive-use recording holding member exists, it is not suitable for a high speed recording.

SUMMARY OF THE INVENTION

The first object of the invention is to provide an electrostatic recording apparatus in which a construction is simple and an electrostatic latent image can be directly recorded onto a general paper.

The second object of the invention is to form a stable electrostatic latent image in addition to the first object.

To accomplish the first object, humidity adjusting means for adjusting a degree of humidity of a recording paper is provided on the upstream side in the conveying direction of a recording medium for latent image forming means for irradiating ions to the recording medium and forming an electrostatic latent image. The humidity adjusting means reduces a moisture content per unit volume of the recording medium and raises a surface resistance value of the recording medium. By raising the surface resistance value of the recording medium, ions can be held at a desired position on the recording medium, so that a blur is reduced and an image can be always recorded at a picture quality of a predetermined quality or higher.

In this instance, the humidity adjusting means may also be drying means for drying the recording medium. Heating means can be used as drying means. A roller heated by a heater, blowing means for blowing the warmed air, or the like can be used as heating means.

To accomplish the second object, in addition to the humidity adjusting means, detecting means for detecting a physical amount indicative of a charging performance of the recording medium is provided. In this instance, a mode to detect the physical amount indicative of the charging performance and a mode to actually print are provided. An amount of ions or a development amount of developing means or both of them are adjusted on the basis of the detected physical amount.

As problems when using the recording medium such as a general paper or the like in which the surface resistance value is largely changed in accordance with the ambient humidity or a humidity degree of the medium itself, in addition to the foregoing problem such that the electrostatic latent image cannot be formed due to the decrease in surface resistance value mentioned above, there can be mentioned a problem such that even after the formation of the electrostatic latent image was enabled by assuring the surface resistance value, the surface resistance value is largely changed due to a humidity degree of the recording medium, so that the picture quality is not stable. To prevent it, by adjusting an amount of ions at the time of formation of the latent image or a development amount of the developing means or both of them, image qualities of recording media of the same material or recording media of different materials can be uniformed.

As a physical amount indicative of the charging performance, for instance, although there is a surface electric potential, a surface resistance, or the like, another value can be also used so long as it is a physical amount which can evaluate the charging performance.

Preferred embodiments according to the invention will now be described hereinbelow. (1) An electrostatic recording apparatus comprising: a supplying unit for supplying a recording medium; electrostatic latent image forming means which has an ion generating source and a control electrode to control a flow of ions and which irradiates the ions to the recording medium supplied from the supplying unit and forms an electrostatic latent image; developing means for developing the electrostatic latent image; and an ejecting unit for ejecting the developed recording medium, wherein the ions which are generated from the ion generating source are directly irradiated to the general paper, thereby forming an electrostatic latent image.

(2) In (1), the general paper is a recording medium whose surface resistance value changes by 10 or more times in a state in which it is left under an environment of humidities of 20% and 80%, respectively.

(3) In (1), the general paper is a recording medium whose surface resistance value changes within a range from $5\times10^7$ ω or more to $2\times10^6$ ω or less in a state in which it is left under an environment of humidities of 20% and 80%, respectively.

(4) Humidity adjusting means for reducing a moisture content of the recording medium is provided on the upstream side in the conveying direction of the recording medium than the electrostatic latent image forming means of (1). Heating means is used as humidity adjusting means. Further, a roll having therein a heater or a heater to heat the air and blowing means for blowing the warmed air to the recording medium are provided as heating means.

In addition to the construction of (4), further, charge amount detecting means for detecting a charge amount of the recording medium and control means for controlling an irradiation amount of ions in the electrostatic latent image forming means and/or a development amount of the developing means on the basis of an output of the charge amount detecting means are provided between the electrostatic latent image forming means and the developing means.

The "general paper" here denotes an ordinary copy paper or a recording medium having characteristics of the general paper shown in FIG. 13. Namely, it is the recording medium having characteristics such that the surface resistance value changes by 10 or more times in a state in which it is left under an environment of humidities of 20 to 80%, respectively. Further, the general paper can be also considered to be a recording medium whose surface resistance value changes within a range from $5\times10^7$ ω or more to $2\times10^6$ ω or less in a state in which it is left under an environment of humidities of 20% and 80%, respectively. In this instance, the general paper doesn't always need to be a paper.

It is sufficient to consider that the surface resistance value is equal to about a value of an exclusive-use electrostatic recording paper. Preferably, it is sufficient to consider that it is $3\times10^6$ ω or more, desirably, $6\times10^6$ ω or more, and more preferably, $1\times10^7$ ω or more. If the humidity adjusting means is provided and the general paper is dried and used, there is a possibility such that the surface resistance value of the recording medium can be set to be higher than that of the exclusive-use electrostatic recording paper. For example, it can be raised to $3\times10^7$ ω or more, further, $1\times10^8$ ω or more, so that a high picture quality of less blur can be obtained.

DESCRIPTION OF THE PREFERRED EMBODIMENTS

An embodiment of the invention will now be described hereinbelow with reference to the drawings.

Figure 1:
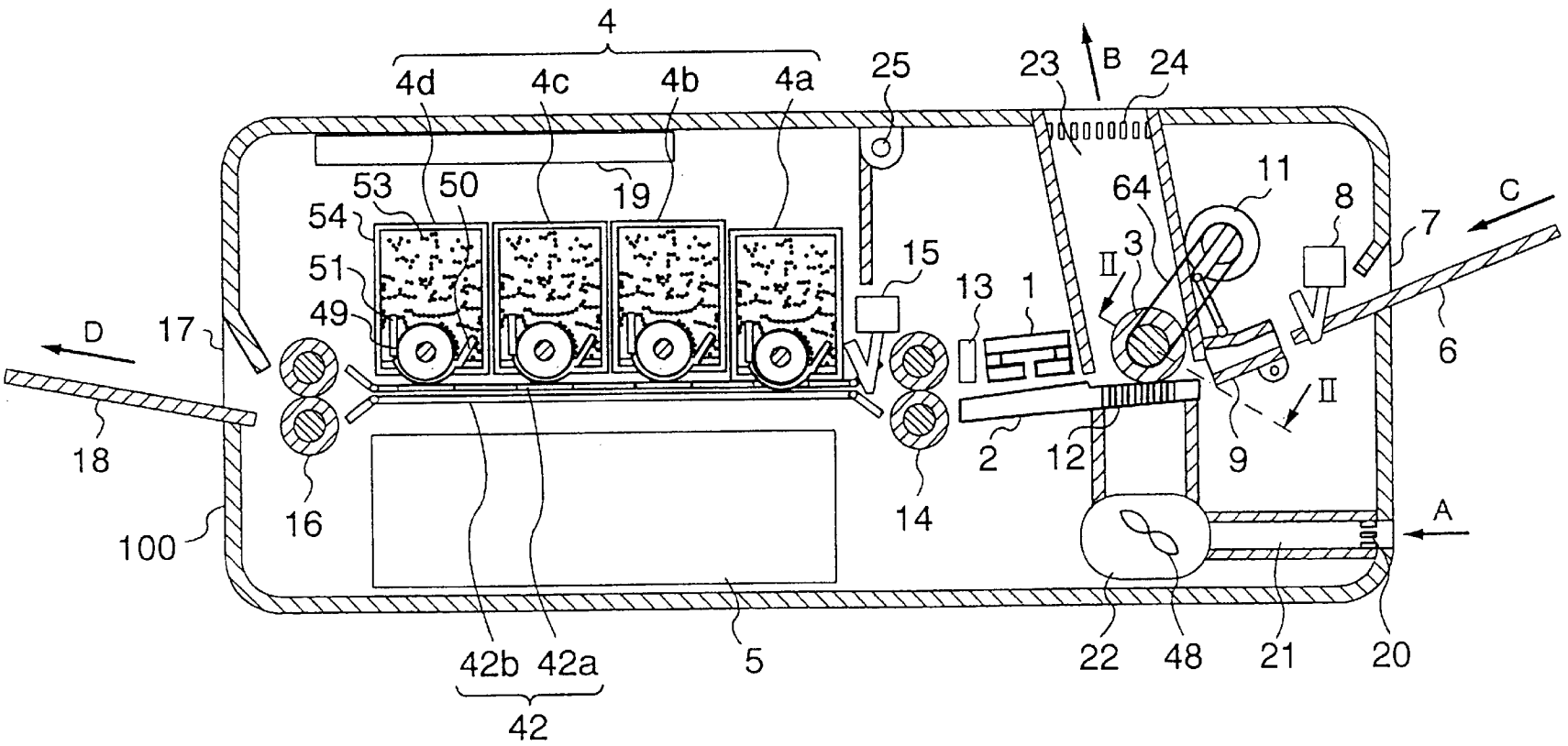
FIG. 1 a cross sectional constructional view when an electrostatic recording apparatus of an embodiment of the invention is seen from the side.

FIG. 1 is a cross sectional view when an electrostatic recording apparatus as an embodiment of the invention is seen from the side.

An electrostatic recording apparatus 100 of the embodiment is constructed by providing a supplying unit of a recording medium, humidity adjusting means, latent image forming means, developing means, and an ejecting unit onto a conveying path on a recording medium from a position where the recording medium was supplied to a position where it is ejected.

First, a construction of the supplying unit will be described.

The supplying unit is constructed by: a tray 6 on which a recording paper (not shown) serving as a recording medium is put; a recording paper inserting slot 7 into which the recording paper is inserted; a variable guide 9 whose guide angle can be changed in dependence on a conveying direction of the recording paper; and a recording paper insertion detector 8 for detecting the insertion of the recording paper in the recording paper inserting slot 7 of the variable guide 9. The variable guide 9 will be described in detail hereinlater.

A construction of the humidity adjusting means (humidistat) will now be described.

The humidity adjusting means is provided at the supplying unit or at the next stage of the supplying unit. The humidity adjusting means has a heating roller 3. A back electrode 2 of the latent image forming means 1 which is provided at the next stage is extended to a lower portion of the heating roller 3. The heating roller 3 sandwiches the recording paper (not shown) together with the back electrode 2 extended and heats the paper. Ventilating means (ventilation ports 20 and 24, ventilation paths 21 and 23, an elbow 22 having therein a fan 48, ventilation ports 12 provided in the back electrode 2) for guiding the air in the portion of the heating roller 3 to an outside of the apparatus is provided. A moisture caused by the heating can be efficiently eliminated from the conveying path by the ventilating means. By attaching meshes of a proper coarseness to the ventilation ports 20 and 24, inflow and outflow of dusts can be prevented.

Figure 2:
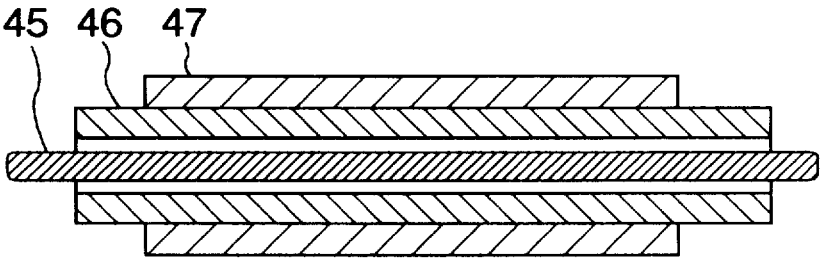
FIG. 2 is a diagram showing a cross section taken along the line II—II of a heating roller 3 shown in FIG. 1.

FIG. 2 is a diagram showing a cross section of a portion taken along the line II—II of the heating roller 3 shown in FIG. 1. In the embodiment, the heating roller 3 is constructed by: a heat resisting rubber portion 47 for conveying the recording paper while heating it; a hollow heat conduction axial core 46 which is rotatably supported to the electrostatic recording apparatus 100 and is used to uniform a temperature distribution of the heat resisting rubber portion 47; and a heater arranged in the heat conduction axial core 46. The roller used as heating means can certainly transfer the heat to the recording paper by directly coming into contact with the recording medium. The roller also has a feature such that a structure is simple and a damage that is exerted on the recording paper is small and it can also commonly function as a conveying roller. In the heating roller 3, since there is a tendency such that a heat radiation in an edge portion in the longitudinal direction increases, a heat generation amount of the heater in the heat conduction axial core 46 in an edge portion can be also set to be larger than that in the center portion in the longitudinal direction. By this method, a heat amount which is applied to the recording paper can be uniformed in the width direction of the recording paper and the surface resistance can be uniformed.

Figure 3:
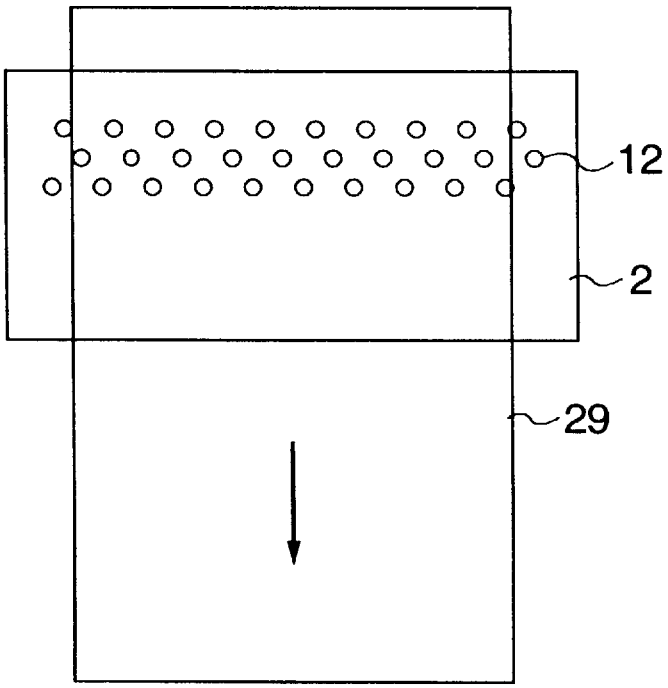
FIG. 3 is a top view of a back electrode which is used in the embodiment shown in FIG. 1.

FIG. 3 shows a top view of the back electrode 2 which is used in the embodiment shown in FIG. 1. In the embodiment, ventilation ports 12 are formed in a zigzag manner in the width direction for the conveying direction of the recording paper 29, thereby uniforming a temperature distribution of the recording paper 29.

A construction of the latent image forming means (latent image forming unit) will now be described.

Latent image forming means 1 is provided at the next stage of the humidity adjusting means. The back electrode 2 is provided so as to face the latent image forming means 1 through the recording paper 29. A charge amount detector 13 for measuring a charge amount of the recording paper 29 is provided at the next stage of the latent image forming means 1. On the further downstream side in the conveying direction, a pair of conveying rollers 14 for conveying the recording paper are provided. The latent image forming means 1 will be described in detail hereinlater together with the operation.

A construction of the developing means will now be described.

Developing means 4 is provided at the next stage of the latent image forming means 1. A recording paper position sensor 15 is provided on the entrance side of the developing means 4 and can detect an arrival of the recording paper. The developing means 4 has developing units 4*a* to 4*d* corresponding to colors of yellow, magenta, cyan, and black. The order of those colors is not limited to the order shown above.

On the lower side of the developing means 4, namely, on the side where toner is adhered to the recording paper, a paper guide 42 having an upper guide 42*a* and a lower guide 42*b* to convey the recording paper is provided. The lower guide 42*b* in the guide 42 has a construction also serving as a development back electrode of the developing means 4. The developing means will be described in detail hereinlater together with the operation.

A construction of the ejecting unit will now be described.

The downstream side in the recording paper conveying direction of the developing means 4 serves as an ejecting unit. A pair of conveying rollers 16 to convey the recording paper, a recording paper ejecting slot 17, and a paper ejection tray 18 are provided in the ejecting unit.

The electrostatic recording apparatus 100 has a control unit 5 for controlling each means as well as the conveyance of the recording paper by receiving sensor outputs of the recording paper insertion detector 8, charge amount detector 13, recording paper position sensor 15, and the like. The control unit 5 will be described in detail hereinlater.

The recording operation of the electrostatic recording apparatus of the invention will now be described with reference to FIG. 1.

When the recording paper 29 is inserted from the recording paper inserting slot 7 into the electrostatic recording apparatus 100 by the operator, recording paper insertion information is detected by the recording paper insertion detector 8. A temperature of the heating roller 3 is raised to a predetermined temperature and the apparatus is set into a recordable mode. After that, when a signal to start the recording operation is supplied from an operation panel 19 by the operator, the heating roller 3 rotates clockwise in the diagram, thereby conveying the recording paper 29 to a position just under the latent image forming means 1. After that, in the latent image forming means 1, ions are irradiated onto the recording paper 29 in accordance with image information. In this instance, a large amount of ions are irradiated to the position corresponding to a portion of a high density of the image information. The forming operation of the latent image will be described in detail hereinlater.

The electrostatic latent image formed on the recording paper 29 in accordance with the image information as mentioned above is developed by the developing means 4. The development is executed by a method whereby toner 53 charged to a polarity opposite to a polarity of ions irradiated from the latent image forming means 1 is selectively adhered onto the portion where an ion flow was irradiated and a toner image is formed.

After the toner image of the first color was formed as mentioned above, the recording paper 29 is again returned to the latent image forming means 1 and the operation of the latent image forming unit is similarly repeated in accordance with each color information, so that toner images of the respective colors are overlaid onto the recording paper 29 and a color image of a full color or the like can be derived. In this instance, the developing means 4 is positioned so as to be located with a predetermined interval from the paper guide 42*b* on the positioning side in correspondence to the color to be developed. In case of shifting to the development of another color, the developing means 4 is refuged from the conveying path in response to the end of development.

At this time, it is preferable to reciprocate the recording paper between the developing means and the heating roller. Thus, a print environment at the time of formation of an image of each color can be almost uniformly held by one humidity adjusting means.

In the embodiment, a uniform charging operation is not performed to the recording paper 29. However, by arranging a charging unit for uniforming charging on the front stage side for the inserting direction of the recording paper of the latent image forming means 1 and by neutralizing the charged charges by the latent image forming means 1, an electrostatic latent image is formed and an image can be also formed.

In the embodiment, one latent image forming means 1 is provided for one apparatus. However, by providing the latent image forming means as many as the number of developing means 4, it is sufficient to convey the recording paper 29 in only one direction without reversing the recording paper 29, so that a recording speed can be raised.

The operation of each unit will now be described in detail hereinbelow.

Figure 4A:
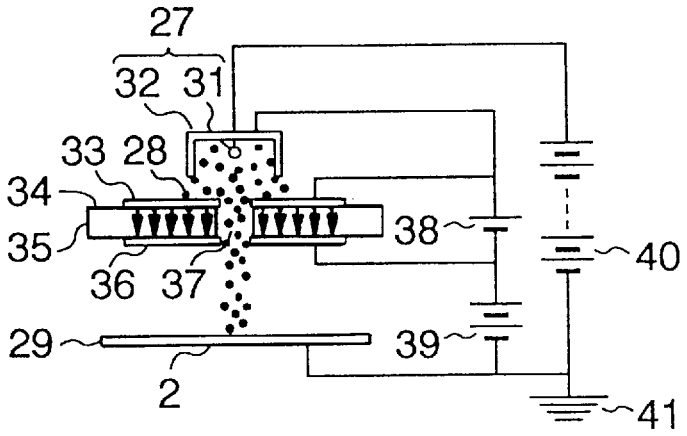
FIGS. 4A and 4B are diagrams for explaining the operation of latent image forming means shown in FIG. 1.

The operation of the latent image forming means will now be described with reference to FIGS. 4A and 4B. FIG. 4A shows a cross sectional view when the latent image forming means when irradiating an ion flow is seen from the side.

The operation when irradiating the ion flow will be first explained by using FIG. 4A.

An ion generating source 27 in the embodiment is formed by: a wire 31 stretched in almost parallel with the width direction (direction perpendicular to the paper surface) of a dielectric material 29 as a recording medium; and a wire casing 32 which has an opening portion in the recording medium direction and is formed so as to cover the wire 31 in the longitudinal direction of the wire 31. A DC high voltage is applied between the wire 31 and the wire casing 32 by a high voltage source 40 for generating ions, so that ions 28 are generated near the wire 31.

A first aperture electrode 33 and a second aperture electrode 36 are provided so as to have a predetermined interval by an insulating material 35 provided between the ion generating source 27 and the dielectric material 29 as a recording medium. An aperture portion 37 is formed so as to penetrate the first aperture electrode 33, second aperture electrode 36, and insulating material 35. A bias voltage is applied between the second aperture electrode 36 and the back electrode 2 formed on the back of the dielectric material 29 by a bias power source 39, thereby forming an electric field in such a direction as to accelerate the ions 28 toward the back electrode 2. Further, a voltage is applied between the first and second aperture electrodes 33 and 36 by a control power source 38, thereby forming a control electric field 34.

In FIG. 4A, since the control electric field 34 is an accelerating electric field to accelerate the ions 28 toward the dielectric material 29, the ions 28 generated by the ion generating source 27 pass through the aperture portion 37 which is formed by penetrating the first aperture electrode 33, insulating material 35, and second aperture electrode 36 and are irradiated to the dielectric material 29. As mentioned above, the ion flow generated from the ion generating source is irradiated onto the dielectric material 29 and forms an electrostatic latent image onto the dielectric material 29.

The operation when suppressing the irradiation of the ion flow will now be described by using FIG. 4B.

In the embodiment, an electric potential of the control power source is changed in accordance with image information to be printed and the direction of the control electric field 34 that is formed between the first and second aperture electrodes 33 and 36 is changed. In FIG. 4B, since the electric field is a suppression electric field to suppress the movement of the ions 28 toward the dielectric material 29, the ions 28 don't pass through the aperture portion 37 which is formed so as to penetrate the first aperture electrode 33, insulating material 35, and second aperture electrode 36. Thus, the ion flow is not irradiated onto the dielectric material 29 as a recording medium and the surface potential of the dielectric material 29 doesn't change.

Figure 4B:
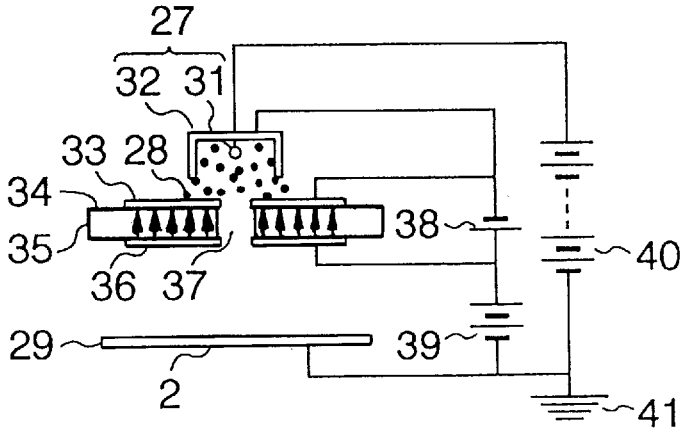

As mentioned above, by controlling the passage and suppression of the ion flow shown in FIGS. 4A and 4B by the electric potential of the control power source 38 in accordance with the image information to be recorded, the electrostatic latent image can be formed on the dielectric material 29 as a recording medium.

In the embodiment, a plurality of aperture portions 37 are formed along the wire 31 at predetermined intervals in the width direction of the dielectric material 29. The first and second aperture electrodes 33 and 36 are formed so as to control a passage amount of each ion flow of the aperture portions 37. A connecting circuit of the power source is not limited to the embodiment but any construction can be also used so long as it can perform the foregoing operation.

It is preferable to form the back electrode so as to have a convex shape on the aperture electrode side. In this instance, by setting the positions in the height direction and a speed difference of the heating roller 3 and conveying rollers 14 so that the recording paper is closely adhered to the back electrode in the aperture portion of the aperture electrode, the interval between the aperture electrode and the recording paper can be certainly set to a predetermined value. Thus, the latent image can be stably formed.

Figure 5A:
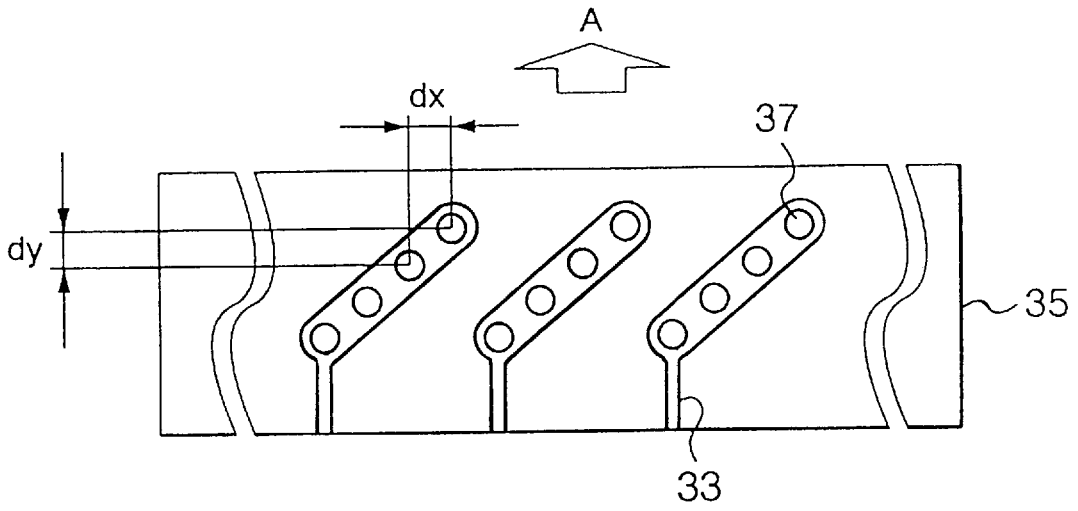
FIGS. 5A and 5B are diagrams showing examples of aperture electrodes of the latent image forming means.
Figure 5B:
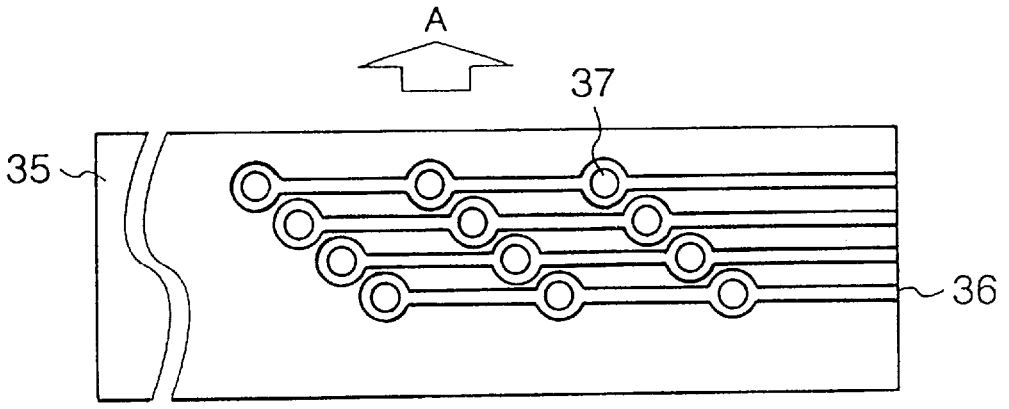

FIGS. 5A and 5B show examples of shapes of the aperture electrodes. As a shape of the aperture electrode, matrix-shaped wiring paths as shown in FIGS. 5A and 5B are formed, a column matrix which is formed by the first aperture electrode 33 and a row matrix which is formed by the second aperture electrode 36 are sequentially selected, and the direction of the control electric field 34 is controlled as shown in FIGS. 4A and 4B in accordance with the image information to be printed corresponding to the selected aperture portion 37, thereby controlling the passage of the ion flow.

Figure 6A:
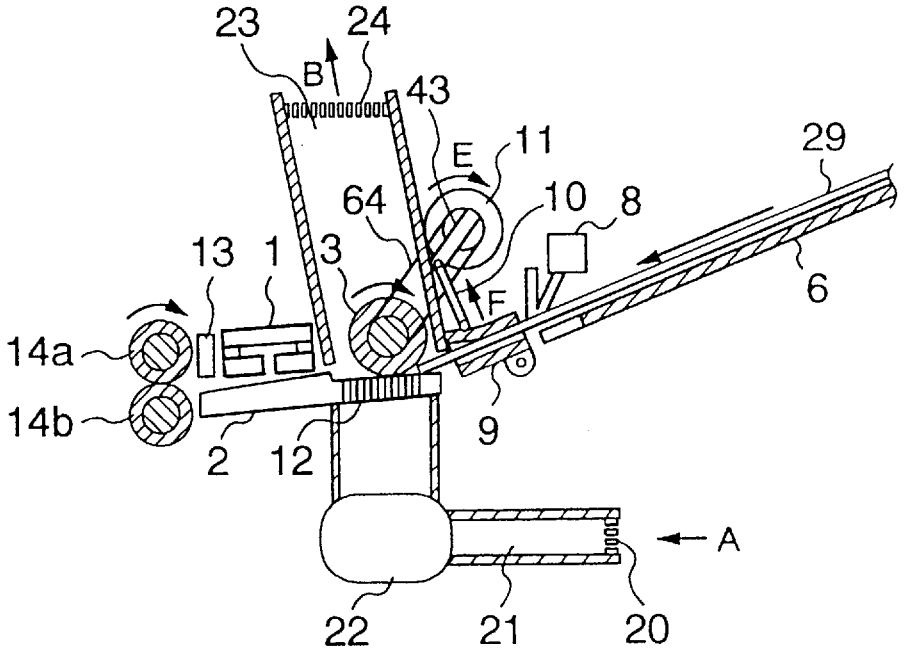
FIGS. 6A and 6B are diagrams for explaining the operation of a recording medium supplying unit in FIG. 1.
Figure 6B:
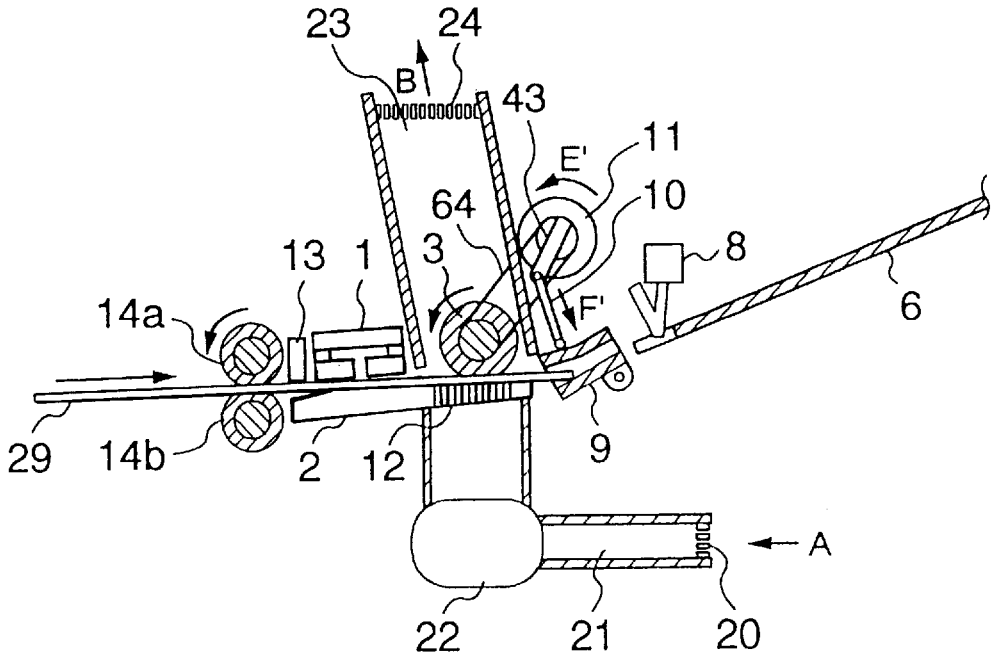

The operation of the variable guide 9 when the recording paper is inserted (supplied) and when the recording paper is returned for the reciprocating operation will now be described by using FIGS. 6A and 6B. FIGS. 6A and 6B show cross sectional views when the supplying unit of the recording paper in the embodiment is seen from the side.

When the recording paper 29 is inserted into the electrostatic recording apparatus 100 from the recording paper inserting slot 7 by the operator, recording paper insertion information is detected by the recording paper insertion detector 8. Thus, a temperature of the heating roller 3 is raised to a predetermined temperature and the apparatus is set to a recordable mode. This state is displayed on the display provided in the operation panel 19 and is shown to the operator. After that, when a signal to start the recording operation is supplied from the operation panel 19 to the operator, the heating roller 3 rotates clockwise as shown by an arrow E in the diagram and the recording paper 29 is conveyed to a position just under the latent image forming means 1. In this instance, the rotation of the heating roller 3 is transmitted to torque generating means 11 by a timing pulley 64.

In association with the rotation, an output arm 43 attached to the output stage of the torque generating means 11 is pulled up in the direction shown by an arrow F in the diagram by a predetermined torque, thereby elevating the variable guide 9 in the direction of the arrow F in the diagram through a guide driving arm 10. Since the torque generating means 11 causes a slip at a predetermined torque or more, by providing position restricting means (not shown), a limit of the movement of the variable guide 9 can be specified. In this instance, the variable guide 9 is positioned so that a front edge in the inserting direction of the recording paper 29 is come into contact with the heating roller contact side of the back electrode 2.

The recording paper 29 conveyed over the latent image forming means 1 is sandwitched by first conveying rollers 14*a* and 14*b* which rotate in the same direction as that of the heating roller 3 and is conveyed.

The operation when the recording paper is returned will now be described with reference to FIG. 6B.

After completion of the development of one color, the heating roller 3, first conveying rollers 14*a* and 14*b*, and second conveying rollers 16*a* and 16*b* start to rotate counterclockwise in the diagram and starts to return the recording paper 29 in the direction shown by an arrow. In this instance, the torque generating means 11 rotates in the direction opposite to the direction upon paper feeding, pulls down the output arm 43 in the direction of an arrow F' in the diagram, and pulls down the variable guide 9. In this manner, a rear edge in the feeding direction of the recording paper is smoothly guided to the variable guide 9. As mentioned above, a cut sheet as a recording paper can be stably, repetitively, and reciprocatingly conveyed without causing a paper jam on the conveying path.

By providing the variable guide which is moved vertically in accordance with the conveying direction of the cut sheet as mentioned above, a paper jam at the time of the reciprocating movement of the cut sheet can be prevented.

Figure 7:
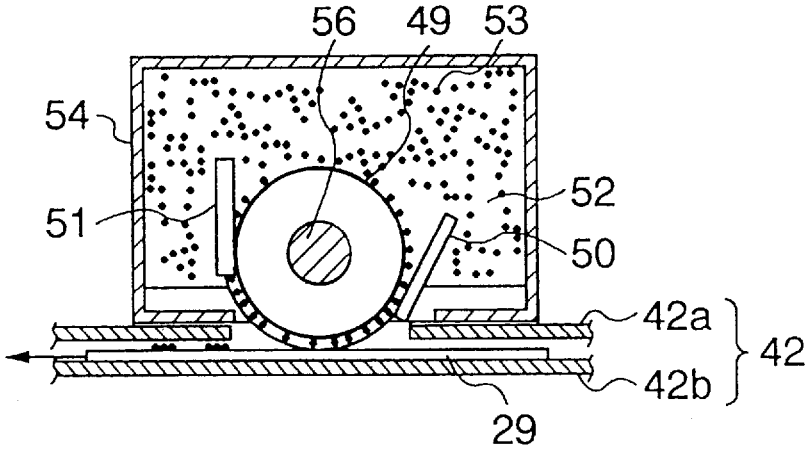
FIG. 7 is a cross sectional view when one of developing units in FIG. 1 is seen from the side.

The operations of the developing units 4*a* to 4*d* will now be described with reference to FIG. 7. FIG. 7 shows a cross sectional view when one of the developing units 4*a* to 4*d* is seen from the side.

In the embodiment, the developing means 4 is a liquid developing device and liquid toner in which the toner 53 charged to a predetermined charge amount is uniformly dispersed in dispersive medium 52 is sealed in a developing unit cover 54. A developing roller in which a part is immersed into the liquid toner and another part is projected from the developing unit cover 54 is held in the developing means 4. The developing roller is constructed by: a developing roller rotary axis 56 arranged so that a rotary axis coincides in the width direction for the conveying direction of the recording paper 29; and a toner holding portion 49 which rotates around the developing roller rotary axis 56 while holding the liquid toner on the circumference.

At the time of the developing operation, the developing means 4 moves downward in the diagram until a predetermined gap is formed between the developing means 4 and a development back electrode 55. Further, the developing roller rotates synchronously with the rotation of the conveying rollers 14 or the like. In association with the rotation of the developing roller, the liquid toner is adhered like a layer onto the circumference of the developing roller. In the embodiment, a control blade 50 is arranged on the liquid toner drawing-up side of the developing roller, thereby controlling a thickness of layer of the liquid toner which is adhered to the developing roller. Further, by providing a scrape-down blade 51 to scrape down the liquid toner which is again collected into the developing means 4 in association with the rotation of the developing roller from the circumference of the developing roller, a layer of the always new liquid toner can be formed onto the circumference of the developing roller.

In a gap portion between the developing roller and the development back electrode 55, a downward (in the diagram) electric field is formed for the charged toner by the electrostatic latent image formed on the recording paper 29 as mentioned in FIG. 4, the toner 53 is moved to the recording paper by an electrophoresis, and a toner image is formed.

The control operation using the charge amount detecting unit 13 will now be described.

After the latent image was formed on the recording paper 29, a surface potential on the recording paper 29 is measured by the charge amount detector 13 and is compared with an amount of ions irradiated to apply such a surface potential, so that characteristics of the recording paper can be grasped. By controlling a bias potential of the developing means on the basis of the information about such characteristics, a surface resistance value of the recording paper can be controlled within a predetermined range, so that a stable image can be always derived. After the characteristics of the recording paper were once grasped by the measurement in the charge amount detector 13 (characteristics detecting mode), the recording paper is returned to the latent image forming means and an ion irradiation amount is corrected on the basis of the above information, so that a stable image can be also derived (image forming mode). Further, by controlling a temperature of the heating roller, a similar effect can be also obtained.

By providing a humidity sensor for the electrostatic recording apparatus and evaluating the characteristics of the recording paper in combination with humidity information, a precision of the above control can be improved.

Explanation will be made further in detail by using FIGS. 8 and 9.

Figure 8:
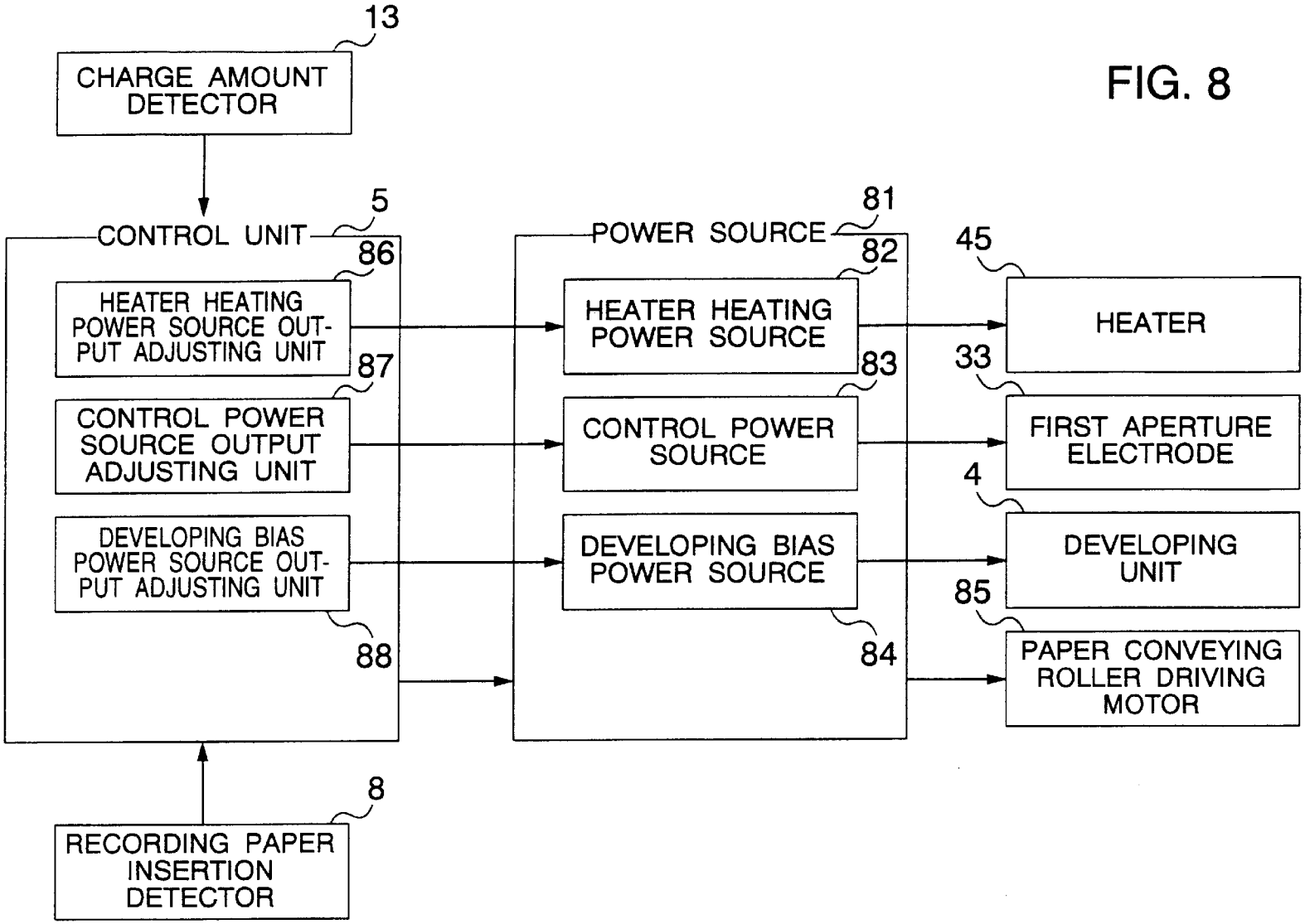
FIG. 8 shows an example of a control signal block diagram of the electrostatic recording apparatus of the invention.

FIG. 8 shows an example of a control signal block diagram of the electrostatic recording apparatus of the invention.

In the charge amount detector 13 arranged on the downstream side of the latent image forming means 1, an output voltage according to an electric potential of a reference electrostatic latent image formed on the recording paper 29 is generated. An output generated from the charge amount detector 13 is inputted to the control unit 5. An output correction amount is calculated by a heater heating power source output adjusting unit 86, a control power source output adjusting unit 87, and a developing bias power source output adjusting unit 88 and each of corrected power source control amounts is supplied to a power source 81. The power source control amounts generated from the output adjusting units are supplied to a heater heating power source 82, a control power source 83, a developing bias power source 84. A voltage according to the power source control amount is generated. The voltages generated from the power sources are respectively inputted to a heater 45, the first aperture electrode 33, and the developing means 4. A heat generation amount of the heater, an irradiation amount of the ions, and a developing bias are controlled by corrected values.

In the embodiment, although a flow of signals regarding the measurement of the characteristics of the recording paper and the control of a print control amount based on the result of measurement is shown, another control necessary to print is also executed in the control unit 5.

Figure 9:
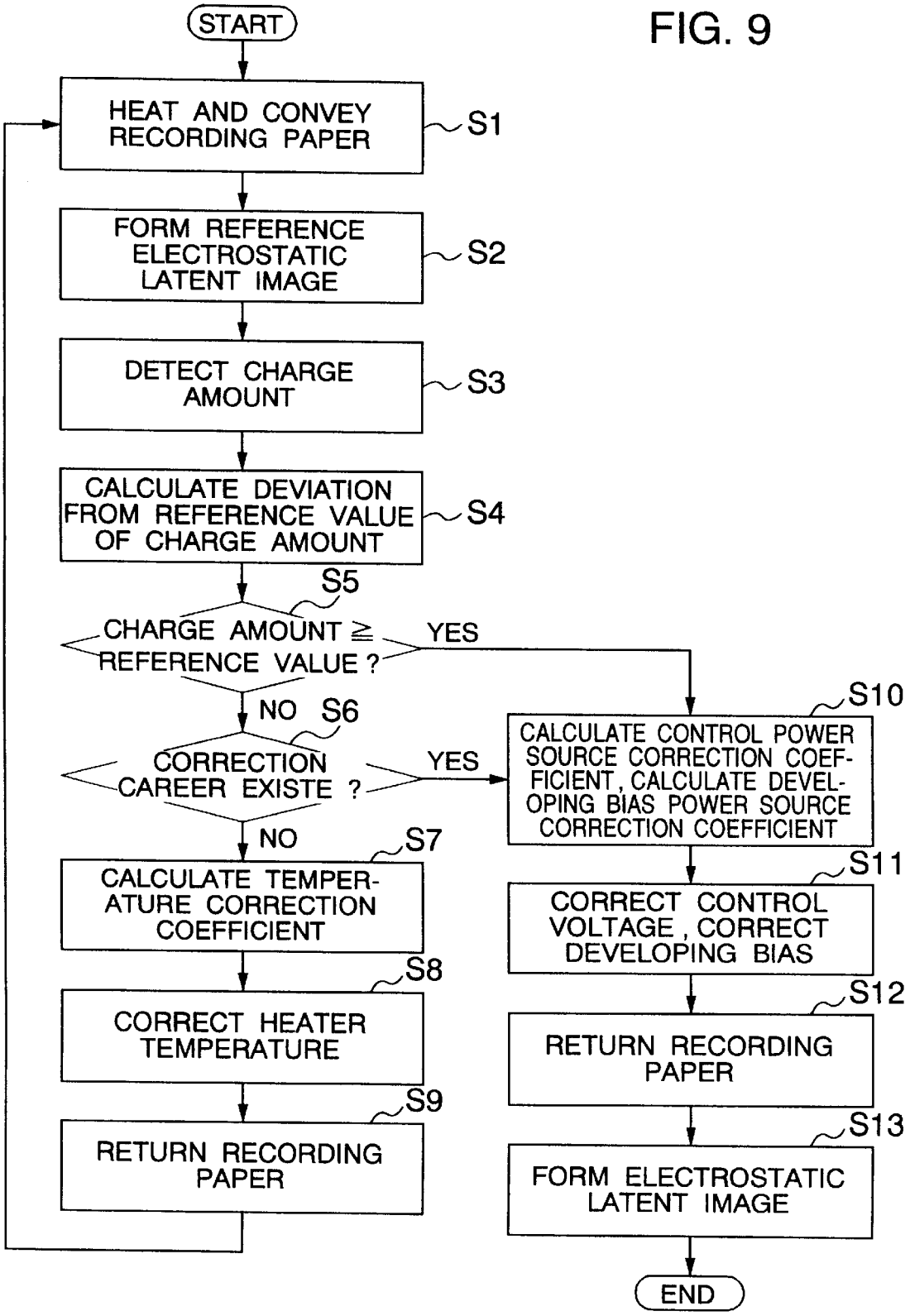
FIG. 9 shows an example of a flowchart for a characteristics detecting step (detecting mode) of a recording paper of the electrostatic recording apparatus of the invention.

FIG. 9 shows an example of a flowchart for a characteristics detecting step (characteristics detecting mode) of the recording paper of the electrostatic recording apparatus of the invention and is shown with respect to a humidity adjusting step (heating step) of the recording paper, a characteristics detecting step of the recording paper as a recording medium, and a latent image forming step.

When a printing operation is instructed by the operation panel 19, a current is supplied to a heater in the heat conduction axial core 46 and the heating roller 3 generates a heat and rotates, thereby conveying the recording paper 29 into the electrostatic recording apparatus 100 (S1). After the recording paper 29 arrived at the latent image forming means 1, a reference electrostatic latent image is formed under predetermined printing conditions (S2). The recording paper 29 is further conveyed and when the portion formed with the reference electrostatic latent image reaches the charge amount detector 13, a charge amount of the reference electrostatic latent image is detected in the charge amount detecting unit 13 (S3). The charge amount of the measured reference electrostatic latent image is compared with a reference charge amount and a deviation between them is calculated (S4).

When an enough dehumidification is not performed upon heating and conveyance of the recording paper, the surface resistance of the recording paper 29 decreases. Therefore, the charges of the recording paper 29 are spread in the width direction of the recording paper 29. The charge amount to be measured decreases with an increase in ratio of a moisture content of the recording paper 29. Therefore, it is sufficient to decide the reference charge amount from a permission value of a spread degree of the electrostatic latent image.

When the charge amount of the reference electrostatic latent image is higher than the reference charge amount, a processing step advances to a correction of latent image forming conditions or the like. However, when it is lower than the reference charge amount, a correction career is examined (S6). After that, a temperature correction coefficient is calculated on the basis of a deviation from the reference value of the charge amount (S7), thereby correcting the temperature of the heater (S8). After that, the recording paper is again heated and conveyed, a reference electrostatic latent image is formed, and a charge amount is detected. On the other hand, when the charge amount of the reference electrostatic latent image is equal to or larger than the reference value, a control power source correction coefficient and a developing bias power source correction coefficient are calculated on the basis of a deviation from the charge amount at this time (S10). The control voltage and the developing bias are corrected (S11).

After that, the recording paper 29 is returned (S12) and a latent image is formed (S13).

Figure 10:
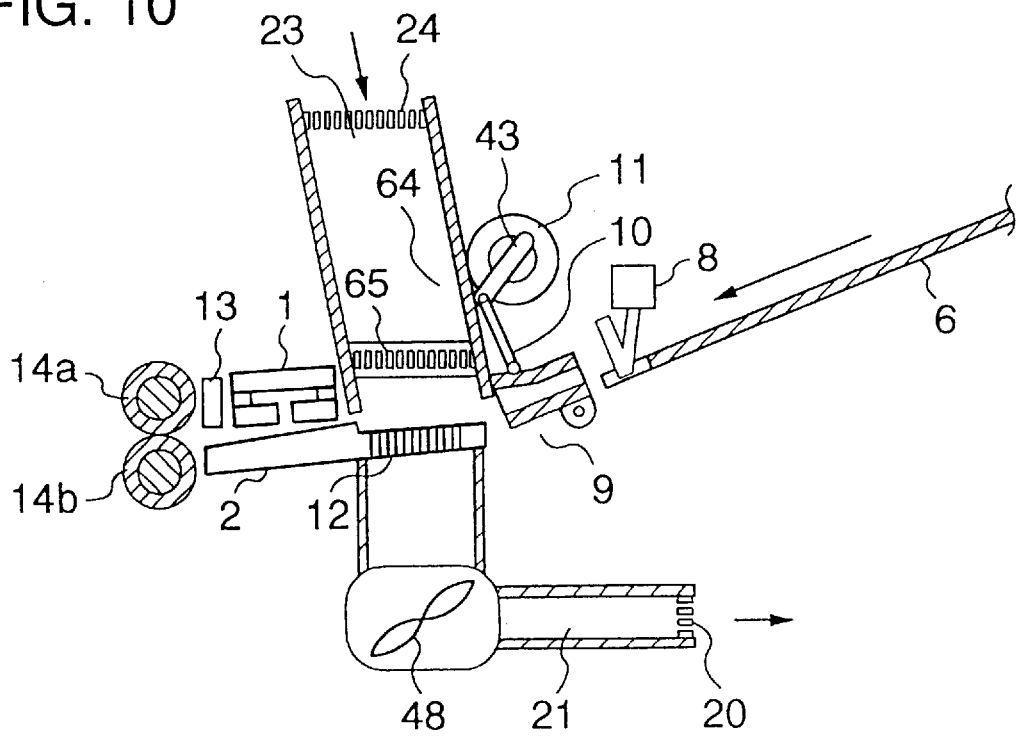
FIG. 10 is a diagram showing an embodiment of heating means as humidity adjusting means of the electrostatic recording apparatus of the invention.

FIG. 10 is a diagram showing another embodiment of heating means as humidity adjusting means of the electrostatic recording apparatus of the invention and shows a cross sectional view when seen from the side. According to the embodiment, a heating slit 65 which is heated to a predetermined temperature is provided in the ventilation path 23. Further, the forced ventilating fan 48 is arranged in the elbow 22 and the air is circulated in the direction shown by arrows in the diagram, thereby heating the recording paper 29.

Figure 11:
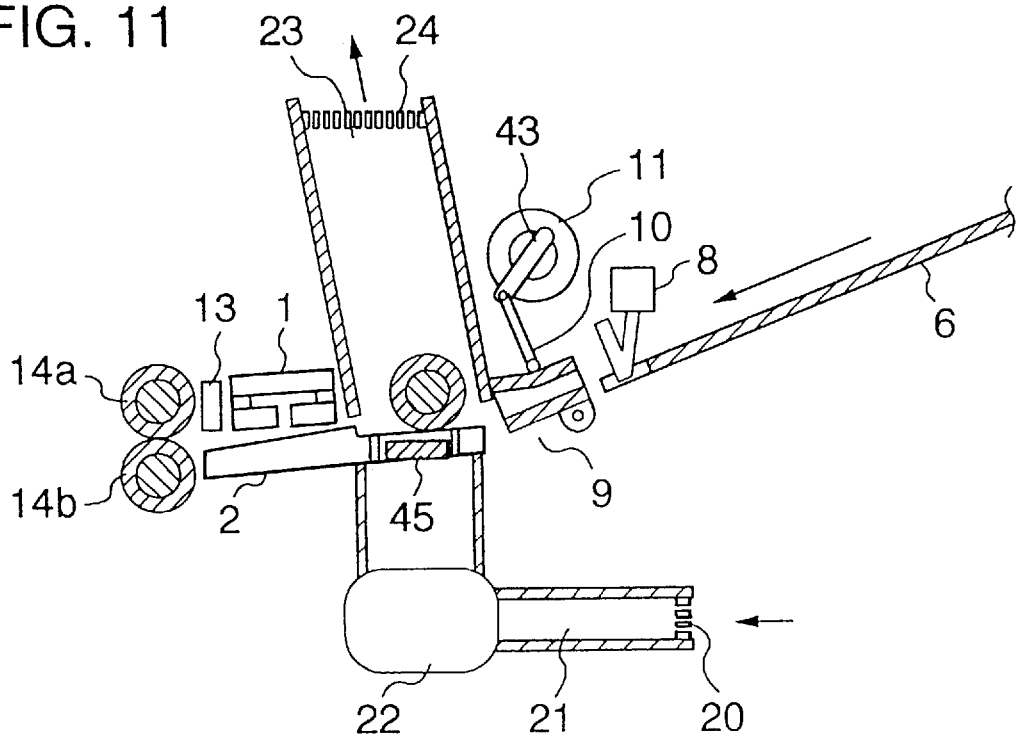
FIG. 11 is a diagram showing another embodiment of heating means as humidity adjusting means of the electrostatic recording apparatus of the invention.

FIG. 11 shows further another embodiment of a heating means as humidity adjusting means of the electrostatic recording apparatus of the invention. In the embodiment, the heating heater 45 is embedded in the surface opposite to the recording paper feeding side of the back electrode 2 and the recording paper 29 can be uniformly heated. A conveying roller 30 doesn't have a complicated construction as shown in FIG. 4 but can be formed by a solid rubber roller which is used in a general office equipment, so that a low price of the apparatus can be realized.

In the embodiment, by using a material with a good heat conductivity as a material of the back electrode 2, the recording paper can be also heated in the latent image forming unit. Thus, a control to set the surface resistance of the recording paper into a predetermined range can be more certainly performed.

Figure 12:
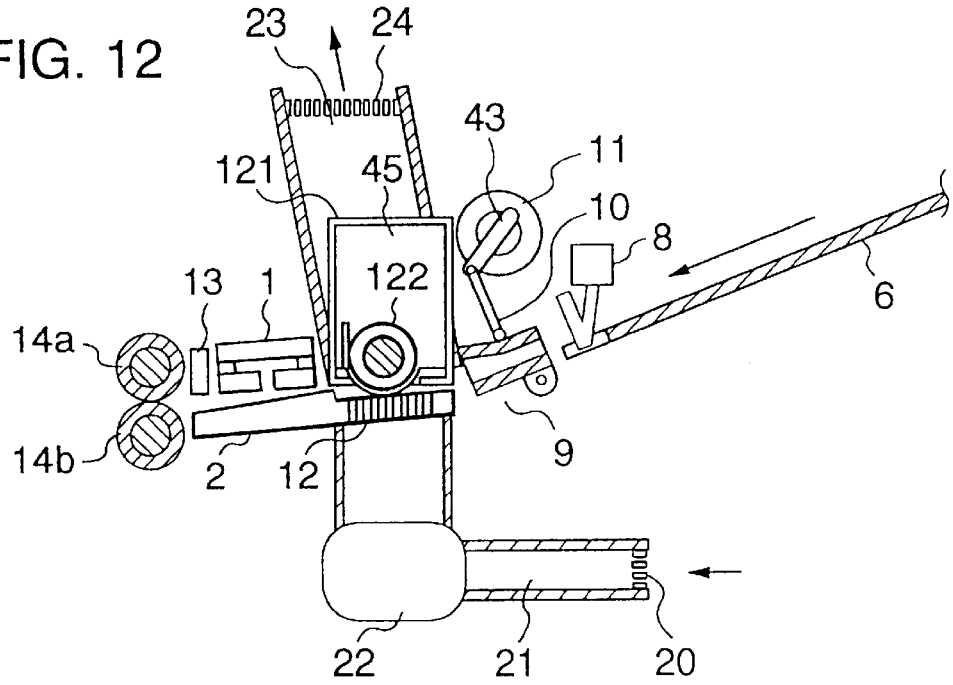
FIG. 12 is a diagram showing another embodiment of an electrostatic recording apparatus of the invention.
Figure 13:
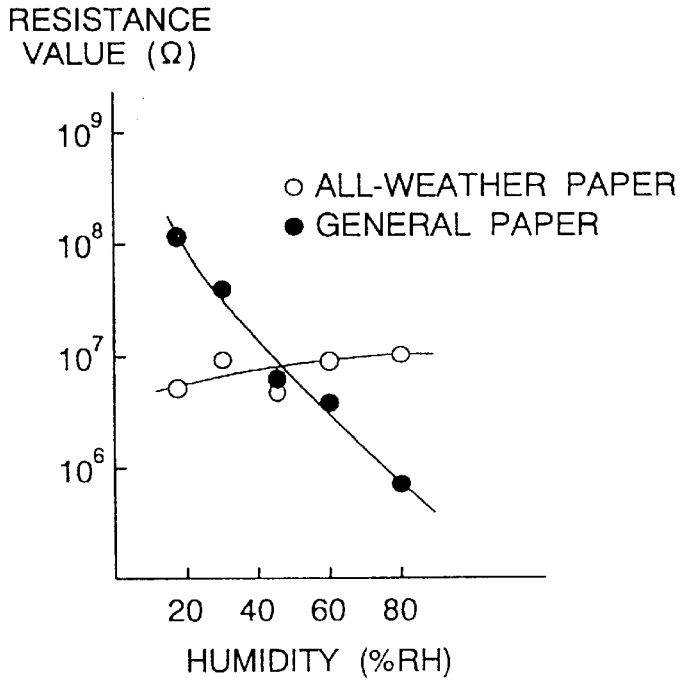
FIG. 13 is a diagram showing humidity characteristics of surface resistance values of an electrostatic recording paper and a general paper.

FIG. 12 is a diagram showing another embodiment of an electrostatic recording apparatus of the invention and shows a cross sectional view when seen from the side. The embodiment is characterized in that a coating layer coating means 45 for coating a coating layer as a dielectric layer onto the recording paper 29 is arranged on a recording paper conveying path in a range from the insertion of the recording paper 29 into the electrostatic recording apparatus 100 to the conveyance to the electrostatic latent image forming means 1. As a material which is used to form the coating layer, a copolymer of vinyl chloride and vinyl acetate, styrenated alkyd resin, methacrylic resin, copolymer resin of styrene and butadiene, or the like can be used.

In FIG. 12, a coating material in a container 121 is thinly coated onto the recording paper by a roller 122. As another method, while pulling out a thin film which is wound like a roll and is used to form a coating layer, the film can be also adhered onto the general paper by a roller. According to the embodiment, by coating a dielectric substance whose insulating resistance has almost the same characteristics as those of a material forming a dielectric layer of the conventional electrostatic recording paper, almost constant surface characteristics can be obtained irrespective of the material of the recording paper to be used, so that a good image can be always printed.

The heater shown in FIG. 11 or the like can be also used to promptly dry the coating layer coated by the coating layer coating means 45.

According to the electrostatic recording apparatus of the invention, after the surface resistance value of the recording medium was raised, a latent image is formed, so that the latent image can be directly formed onto the recording medium whose surface resistance value deteriorates in association with a change in ambient humidity. Since an amount of ions which are charged on the recording medium or a development amount is controlled in accordance with the charging performance of the recording medium, even in case of the recording medium whose surface resistance value changes in dependence on the ambient humidity, a uniform image can be recorded in an electrostatic recording apparatus of an ion flow recording system.

What is claimed is:

1. An electrostatic recording apparatus comprising: a supplying unit for supplying a recording medium; latent image forming means which has an ion generating source and control electrodes for controlling a flow of ions, irradiates the ions onto the recording medium supplied from said supplying unit, and forms an electrostatic latent image; developing means for developing said electrostatic latent image; and an ejecting unit for ejecting the developed recording medium, wherein the ions generated from said ion generating source are directly irradiated onto a general paper, thereby forming the electrostatic latent image; and wherein said general paper is a recording medium whose surface resistance value changes by ten times or more in a state in which it is left under an environment of humidities of 20% and 80%, respectively.

2. An electrostatic recording apparatus comprising: a supplying unit for supplying a recording medium; latent image forming means which has an ion generating source and control electrodes for controlling a flow of ions, irradiates the ions onto the recording medium supplied from said supplying unit, and forms an electrostatic latent image; developing means for developing said electrostatic latent image; and an ejecting unit for ejecting the developed recording medium, wherein the ions generated from said ion generating source are directly irradiated onto a general paper, thereby forming the electrostatic latent image; and wherein said general paper is a recording medium whose surface resistance value changes in a range from $5\times10^7$ ω or more and $2\times10^6$ ω or less in a state in which it is left under an environment of humidities of 20% and 80%, respectively.

3. An electrostatic recording apparatus comprising: a supplying unit for supplying a recording medium; latent image forming means which has an ion generating source and control electrodes for controlling a flow of ions, irradiates the ions onto the recording medium supplied from said supplying unit, and forms an electrostatic latent image; developing means for developing said electrostatic latent image; and an ejecting unit for ejecting the developed recording medium, wherein means for forming a film of a dielectric material onto said recording medium is provided on a surface on the side of the recording medium where the electrostatic latent image is formed on an upstream side in a conveying direction of the recording medium than said latent image forming means.

4. An electrostatic recording apparatus comprising: a supplying unit for supplying a recording medium; latent image forming means which has an ion generating source and control electrodes for controlling a flow of ions, irradiates the ions onto the recording medium supplied from said supplying unit, and forms an electrostatic latent image; developing means for developing said electrostatic latent image; and an ejecting unit for ejecting the developed recording medium, wherein said electrostatic recording apparatus further has humidity adjusting means, arranged on an upstream side in a conveying direction of the recording medium than said latent image forming means, reducing a moisture content of said recording medium, charge amount detecting means, arranged between said latent image forming means and said developing means, for detecting a charge amount of the recording medium, and a control unit for controlling an ion irradiation amount of said latent image forming means and/or a development amount of said developing means on the basis of an output of said charge amount detecting means.

5. An apparatus according to claim 4, wherein said control unit forms a reference electrostatic latent image onto said recording medium and controls a charge amount of said latent image on the basis of a surface electric potential which is detected by said charge amount detecting means.

6. An electrostatic recording apparatus comprising: a supplying unit for supplying a recording medium; latent image forming means which has an ion generating source and control electrodes for controlling a flow of ions, irradiates the ions onto the recording medium supplied from said supplying unit, and forms an electrostatic latent image; developing means for developing said electrostatic latent image; and an ejecting unit for ejecting the developed recording medium, wherein heating means for reducing a moisture content of said recording medium is provided on the upstream side in a conveying direction of the recording medium than said latent image forming means, said latent image forming means has an ion generating source, control electrodes for controlling a flow of ions between said ion generating source and said recording medium, and a back electrode arranged on the side opposite to said ion generating source through said recording medium, and heating means for heating the back electrode is provided for said back electrode.

7. An electrostatic recording apparatus comprising: a supplying unit for supplying a recording medium; latent image forming means which has an ion generating source and control electrodes for controlling a flow of ions, irradiates the ions onto the recording medium supplied from said supplying unit, and forms an electrostatic latent image; developing means for developing said electrostatic latent image; and an ejecting unit for ejecting the developed recording medium, wherein a heating roller, having therein a heater, for reducing a moisture content of said recording medium is provided on the upstream side in a conveying direction of the recording medium than said latent image forming means, said latent image forming means has an ion generating source, control electrodes for controlling a flow of ions between said ion generating source and said recording medium, and a back electrode arranged on the side opposite to said ion generating source through said recording medium and extended to said heating roller so that said heating roller comes into pressure contact with said back electrode.

8. A recording method of an electrostatic recording apparatus in which ions are irradiated onto a recording medium supplied from a supplying unit, an electrostatic latent image is formed, said formed electrostatic latent image is developed, and thereafter, said recording medium is ejected, comprising:

a humidity adjusting step of reducing a moisture content. of said recording medium to enable proper latent image formation;

a step of forming a latent image after said humidity adjusting step;

a step of detecting a charge amount of said recording medium after the latent image was formed to enable proper development; and a developing step of developing after the charge amount was detected.

9. An electrostatic recording apparatus comprising: a supplying unit for supplying a recording medium; latent image forming means which has an ion generating source and control electrodes for controlling a flow of ions, irradiates the ions onto the recording medium supplied from said supplying unit, and forms an electrostatic latent image; developing means for developing said electrostatic latent image; and an ejecting unit for ejecting the developed recording medium, wherein a heating roller having therein a heater for reducing a moisture content of said recording medium is provided on the upstream side in a conveying direction of said recording medium than said latent image forming means and having a function to convey the recording medium is provided, said latent image forming means has an ion generating source, a control electrode having first and second aperture electrodes for controlling a flow of the ions between said ion generating source and said recording medium, and a back electrode which is positioned on the side opposite to said ion generating source through said recording medium, is extended to said heating roller so that the heating roller comes into pressure contact with said heating roller, has a curved surface in which the side facing apertures of said first and second aperture electrodes is convex in the conveying direction, and has a penetrating port for ventilation in a portion to which said heating roller comes into pressure contact, and said electrostatic recording apparatus further has blowing means for ejecting the air in a heating unit of the recording medium to an outside of the apparatus through said penetrating port, charge amount detecting means, arranged22 between said latent image forming means and said developing means, for detecting a charge amount of said recording medium, and a control unit for controlling an irradiation amount of the ions of said latent image forming means and a development amount of said developing means on the basis of an output of said charge amount detecting means.

* * * * *